US006503159B2

(12) United States Patent
Pehr

(10) Patent No.: US 6,503,159 B2
(45) Date of Patent: Jan. 7, 2003

(54) FOOTBALL GAME

(76) Inventor: Harold T. Pehr, 12325 Horton, Overland Park, KS (US) 66209

( * ) Notice: Subject to any disclaimer, the term of this patent is extended or adjusted under 35 U.S.C. 154(b) by 60 days.

(21) Appl. No.: 09/804,771

(22) Filed: Mar. 13, 2001

(65) Prior Publication Data

US 2002/0183139 A1 Dec. 5, 2002

(51) Int. Cl.[7] ..... A63B 63/00
(52) U.S. Cl. ..... 473/477; 273/317.5
(58) Field of Search ..... 473/477, 476, 473/415, 478; 273/317.5

(56) References Cited

U.S. PATENT DOCUMENTS 3,865,371 A 2/1975 Theriot
4,023,798 A 5/1977 Pronin
4,911,443 A 3/1990 Foster
5,160,138 A 11/1992 Sanders
6,045,466 A 4/2000 Suess
6,161,833 A 12/2000 Gomez
6,168,159 B1 1/2001 Kulick

OTHER PUBLICATIONS

Colossus Fantasy Football www.colossusinc.com pp. 1–12, Dec. 1, 2000.*

2001 NCAA Football Rules www.ncaa.org/library/rules/ 2001 pp. 1–2, FR–96, Nov. 21, 2001.*

* cited by examiner

*Primary Examiner*—Sebastiano Passaniti
*Assistant Examiner*—M. Chambers
(74) *Attorney, Agent, or Firm*—Posinelli Shalton Welte, P.C.

(57) ABSTRACT

The present invention relates to a method for playing football, wherein points attributed to made field goals are determined by the distance from which the ball was kicked. As the distance is increased, the point value for a successful kick correspondingly increases, with the team kicking having the option of moving the ball farther away from the goal so as to increase the point value of a successful kick.

10 Claims, 2 Drawing Sheets

Fig. 2.
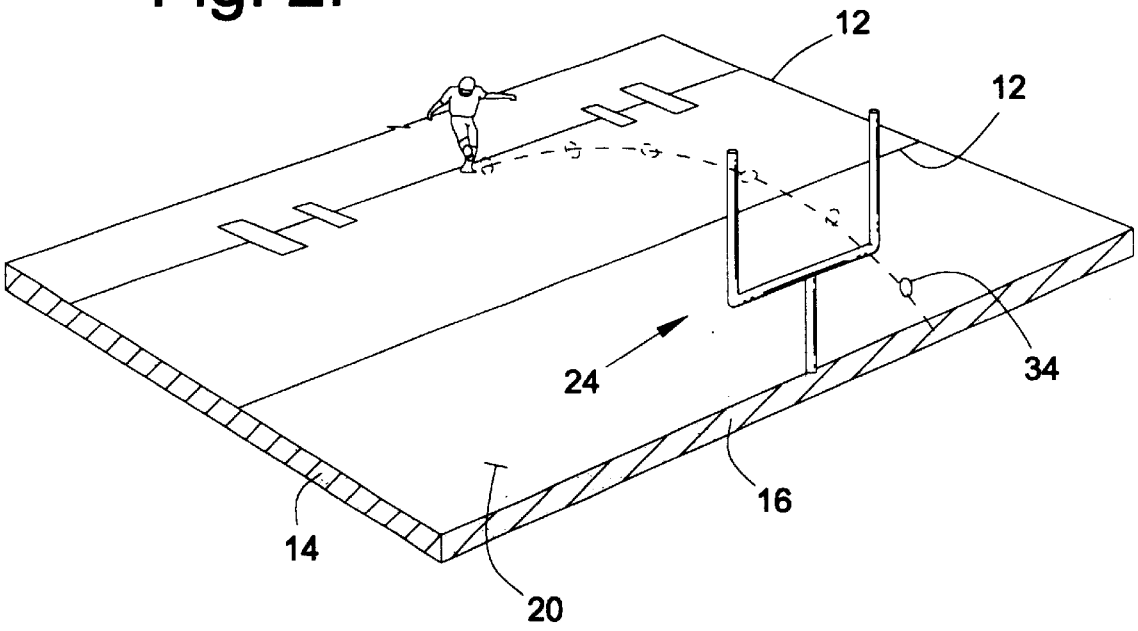
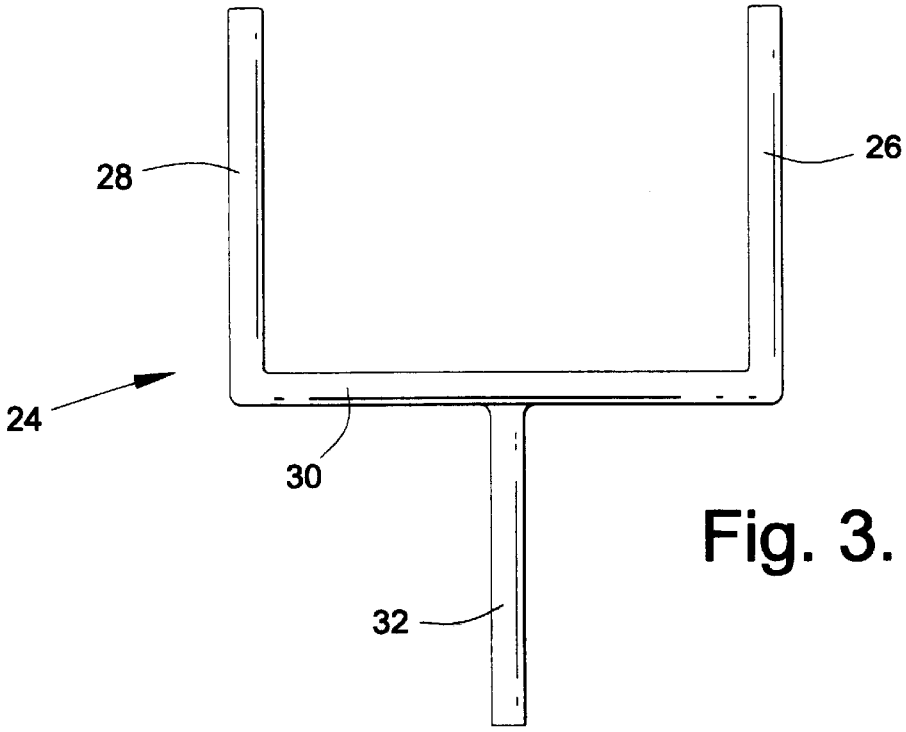
Fig. 3.

FOOTBALL GAME

FIELD OF THE INVENTION

The present invention relates to a method of playing football, whereby the rules of the game include attribution of increasing point values for made field goals of increasing distances. A participant or team who is kicking a field goal can elect to move the ball farther from the goal in order to increase the point value of the kick.

BACKGROUND OF THE INVENTION

American football at the high school, college, and professional levels is an immensely popular spectator sport in the United States. With the exception of some minor changes, the sport has remained essentially unchanged over the years. Generally speaking, football is played on a playing field having a width of 160 feet and a length of 100 yards. A scoring zone or end zone is located in each end of the field and is 160 feet wide and 10 yards in length. The game is played by two opposing teams, each fielding eleven players at any given time. The opposing teams are designated as the team on offense (the team in possession of the ball) and the team on defense (the team defending a goal line against the team on offense). The team on offense tries to move the ball down the field to score by advancing the ball past the goal line and into the end zone defended by the team on defense. The object of the game is to score more points than the opposing team within the designated playing time.

A team scores a touchdown when one of its players carries the ball into the opposing team's end zone or catches a pass in the end zone. A touchdown is worth six points. After a team has scored a touchdown, it tries for an extra-point conversion. This is an opportunity to score an additional one or two points with no time elapsing off the game clock. A running or passing conversion in which the ball crosses the goal line counts for two points. A place-kick between the goalposts and over the crossbar counts for one point. The extra-point is also referred to herein as an extra point field goal because it is a kick similar to a field goal. Typically, the goalposts are eighteen feet, six inches wide, and are connected by a crossbar.

On offense, teams may also attempt to score by kicking a field goal between the goalposts and over the crossbar. Typically, a field goal counts for three points. A field goal is scored by means of a place-kick, in which one player holds the ball upright on the ground for a teammate to kick. The team having the most points at the end of the designated playing time is deemed the winner of the game.

These scoring rules generally apply to other variations of football played out-of-doors. Such as Canadian rules football (where the field is wider), eight man football, flag football, and indoor football (where the field is smaller). Variations of the traditional game include video games and board games. The video and board games are based on the rules of traditional football. Regardless of the particulars, football is typically played by two teams with points awarded for field goals and touchdowns.

As such, whether the particular football game being played is flag football, contact football, played on a video game, or as a board game, near the end of regulation the teams will either be tied or one team will be behind. If a team is behind by three points, then a field goal, under the existing rules, can be kicked to tie the game. If the team, however, is behind by an amount greater than three points, then a touchdown must be scored to either win or tie the game.

Often, the probability of scoring a touchdown in such a situation is highly unlikely. Conversely, the probability of successfully kicking a long field goal has a higher chance of success. Under the existing rules, no matter where the ball is kicked from, a field goal equals three points. It would be desirable, however, to have a game whereby field goals or extra points from different distances equate to different point values. This would allow teams the option of either attempting a long touchdown play or kicking a long field goal or extra point. Thus, it is desired to have a football game whereby the value for kicking a field goal or extra point is proportionate to the distance the ball is kicked. It is also desired if the game includes rules whereby the team kicking may choose to move the ball further from the goal so as to increase the point value of the kick.

BRIEF SUMMARY OF THE INVENTION

The present invention relates to a method for playing football, whereby specific point values are attributed to field goals and/or extra-points kicked and made from predetermined distances. The method comprises assigning point values to varying distances so that as the ball is located farther from the goal post, the point value for successfully kicking a field goal is increased. The method includes the additional rule of having the option of moving the ball farther from the goalpost so as to increase the point value of a successful kick. This allows the team kicking to more easily make up a deficit.

If the kick is unsuccessful, the ball will be taken over by the team on defense at the place from which the ball was snapped. Additionally, a penalty can be assessed against the kicking team so that the team taking over starts with better field position.

Other rules associated with football can be included in the present method; however, it is most important to realize that the present game is primarily focused on point values attributed to successfully kicking field goals or extra points. The present game can be played indoors or outdoors with any number of players, and on a board, field, or as part of a video game.

The present game is advantageous over other methods because teams that are behind can more easily make up the deficit by kicking field goals and/or extra points as opposed to having to score touchdowns. Additionally, the game is more exciting because a team is presented with more than one option for scoring significant numbers of points. A team can also employ different strategies previously unavailable when trying to take the lead or tie a football game.

BRIEF DESCRIPTION OF THE DRAWINGS

FIG. 2 is an enlarged perspective view of a player kicking a field goal; and, FIG. 3 is a front view of a goalpost.

DETAILED DESCRIPTION OF THE INVENTION

Figure 1:
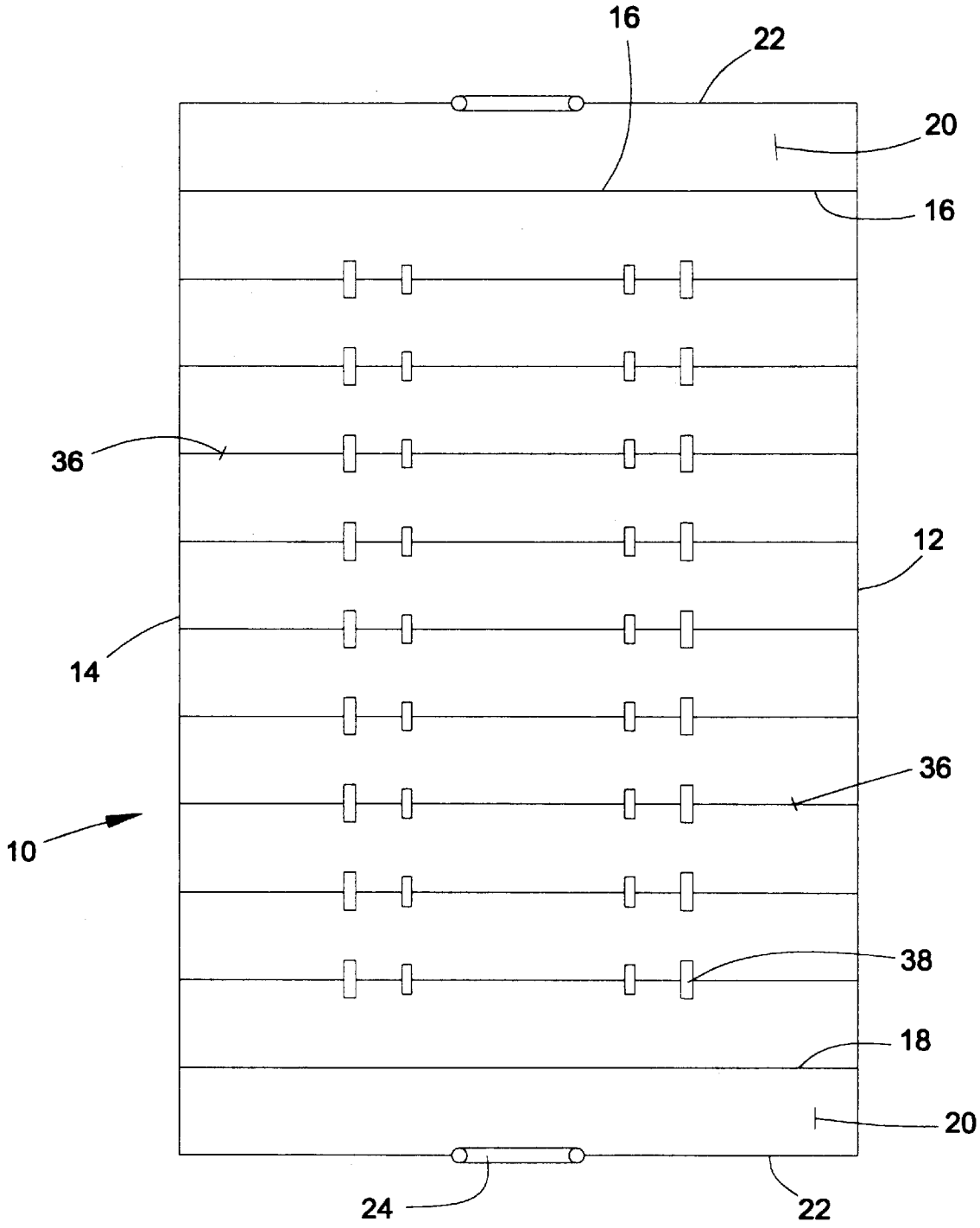
FIG. 1 is a top view of a standard football field.

The present invention relates to a new method for playing the game of football. The new game includes a new set of rules associated with the kicking of field goals and extra points, whereby points attributed to a successful kick correspondingly increase with the distance the ball is kicked. The team kicking can elect to move the ball to a position whereby the point value is increased as compared to the original kicking position. This is advantageous because a team playing the game is afforded more than one way to make up a point deficit if they are behind. For example, if the ball is on the 25-yard line then, theoretically, the kick might equal three points; however, under the current method, the ball could be moved to the 50-yard line so that the kick would equal five points.

A typical playing field 10, shown in FIG. 1, will have two pairs of opposing out-of-bounds lines 12, 14, 16, and 18, which define a generally rectangular-shaped playing area. The rectangular shape is generally suitable for playing surfaces located out-of-doors or indoors, as well as a board game or a video game. The preferred approximate dimension of the out-of-doors field is 100 yards in length by 160 feet wide. One pair of the out-of-bounds lines are parallel sidelines 12 and 14. The other pair of out-of-bounds lines includes parallel goal lines 16 and 18 that connect with the two sidelines 12 and 14 and form a right angle at each junction. At either end of the regulation field is an end zone 20 defined by the area between the goal lines 16 or 18 and an end line 22. Each end line 22 is parallel to the associated goal lines 16 and 18 and runs the width of the regulation field at a location of approximately 10 yards upfield from the goal lines.

Again, for indoor football, or where the game is played via a board or video game, the dimensions may be different, but the rectangular shape of the field will remain the same. The present game can be played on an indoor or outdoor field, a board, or via a video game.

Located above each end line 22 of the regulation field 10 is a goalpost 24. The goal post is more clearly shown in FIGS. 2 and 3. It is made of two parallel and vertical bars 26 and 28 separated by an 18 foot 6 inch long horizontal crossbar 30. The vertical bars 26 and 28 extend approximately 30 feet high above the crossbar. The goal post is supported by the post 32. The area above the crossbar 30 and between the two vertical bars 26 and 28 defines a scoring area. By kicking a ball 24 through the scoring area, as shown in FIG. 2, a team may score points. Each goalpost 24 is elevated above the associated end lines 22 such that the crossbar 30 is 10 feet above the playing field 10. The goalpost 24 is located along the length of the end line 22 such that the scoring area is centrally located above the end lines 22.

The present game method includes, importantly, new rules related to kicking a field goal. Other rules, however, may be included. As in traditional American football, one of two opposing teams attempts to move a ball 34 on the field 10 in accordance with the rules as explained hereafter. The ball 34 is placed so that its tip (the ball is approximately the shape of an oblong spheroid) is pointed upfield and tangent to a line traversing the width of the field and parallel to the goal lines 16 and 18 (i.e., perpendicular to the sidelines 12 and 14).

Both under the rules of the instant game and the rules of American football, the line that is tangent to the tip of the ball is called the line of scrimmage. Each team lines up on opposing sides of the line of scrimmage. Upon movement of the ball 34 by the team in possession of it, players may cross the line of scrimmage to either advance the ball upfield or tackle the player with the ball. A play ends when the player with the ball 34 is tackled, runs out of bounds (past the sidelines 16) or crosses the upfield goal line 22. A team loses possession of the ball 34 if it does not advance the ball more than a predetermined distance in four successive plays. Preferably, the predetermined distance is 10 yards as in American football.

In order to provide for accurate relative placement of the ball, the regulation field is divided by a plurality of placement-marking lines 36 that are used to visualize the lines of scrimmage at equal incremental distances from one end zone to the other. Each marking line 36 is preferably a strip of approximately five to six inches in width that extends from one sideline 12 to the other 14. As illustrated, the playing field 10 is marked in ten-yard increments.

Each marking line 36 includes hash marks 38 for placement of the ball 34 relative to the sidelines 16. Each of these hash marks 38 is approximately 12 inches long and is placed so that its longitudinal axis is parallel to the sidelines 12 and 14. Preferably, each marking line 36 includes a pair of hash marks 38 with each mark placed a predetermined distance from the nearest sideline 12 or 14.

Players. Eight to eleven players on offense and eight players to eleven on defense, with both sides having an equal number of players. Five offensive players must be lined up at the line of scrimmage. A minimum of three defensive players must be lined up at the line of scrimmage. In an alternative embodiment, the game can be played with only one player, with the player tracking his/her score at each successful field goal. Other combinations of players may be used.

Time of Play. Generally, four 15-minute quarters with a 15-minute halftime. The time between plays typically does not exceed 30 seconds. Each team will be allowed three timeouts per half. Variations of the listed times may also be used.

Movement of Ball and Scoring. Four downs allowed to move the ball ten yards for a first down. Six points for a touchdown. One point for a conversion by place kick after touchdown. Two points for a conversion by drop kick after touchdown. Two points for a conversion by successful run or pass after touchdown.

The team on offense may also kick the ball 34 through the uprights in order to score points. The points allotted for such kick are determined according to the distance from which the ball was kicked. Different values can be attributed to different distances so that kicks of longer distance are worth more than kicks of shorter distances. It is preferred if a kick ranging between 0 yards and 10 yards equals one point, between 11 yards and 20 yards equals two points, 21 yards and 25 yards equals 3 points, 26 yards and 35 yards equals four points, 36 yards and 45 yards equals five points, 46 yards and 55 yards equals six points, and a kick ranging between 55 yards and beyond equals seven points. These values can be adjusted so that different points are attributed to the different ranges.

Another aspect to the present game is that a team may elect to move a ball 34 farther back when kicking a field goal. This allows the team to increase the point value for the kicked ball by moving the ball farther from the goal post. For example, if the ball 34 was spotted at the 10 yard line, such a kick would be worth one point; but, if the team is behind by four points, it may be advantageous to move the ball 34 to the 36 yard line so as to make a kick equal to five points and to, thereby, take the lead. This gives teams the option of selecting the distance from which they kick so as to select the particular point values associated with each kick. Thus, under the present method, the ball is placed on the line of scrimmage, the team kicking then notifies the official of the desire to kick a field goal of a higher point value. The official then moves the ball back to a position for snapping, whereby the kick will be of a higher point value. This is followed by kicking the ball. The point value is determined by the distance from which the ball is kicked, not from where it is snapped.

Instead of moving the ball back on a field goal, such an election can be made for an extra point. Thus, the ball can be moved back to a particular distance to cause a successful extra point to be worth increasing point values, dependent upon the distance the ball is kicked. For example, instead of kicking an extra point equal to one point, the ball could be moved back so that a successful kick would equal between two to six points, dependent upon the distance of the kick.

It is preferred if the number of times the ball is moved for either a field goal or an extra point of enhanced value be limited. For example, the rules will limit the election to only four times per game.

Another option involves assessing a penalty to the team kicking if there is a miss. Such penalty could result in the ball being moved from the spot from which it was kicked. If the penalty was assessed as a result of a missed extra point, then the ball could be moved farther from the receiving team's end zone. Thus, the team that missed the kick would be penalized a certain number of yards.

If a kick is missed, the team playing defense will take over the ball to play offense. The ball will be positioned at the point from where the ball was hiked on the unsuccessful kick.

No matter how many players are involved or the type of field, the present game includes rules whereby field goals and extra points equal different point values according to the distance kicked.

Thus, there has been shown and described a game method relating to a football game which fulfills all the objects and advantages sought therefore. It is apparent to those skilled in the art, however, that many changes, variations, modifications, and other uses and applications for the football game are possible, and also such changes, variations, modifications, and other uses and applications which do not depart from the spirit and scope of the invention are deemed to be covered by the invention, which is limited only by the claims which follow.

What is claimed is:

1. A method of playing football wherein specific point values are attributed to field goals kicked from predetermined distances, comprising the steps of:

(a) providing a generally rectangular playing field having
  (i) a first end line and a second, opposing end line, a distance between said end lines defining a length of said playing field,
  (ii) opposing side lines, said opposing side lines defining boundaries of play and a distance between said side lines defining a width of said playing field, and
  (iii) first and second goal lines parallel to said first and second end lines and spaced inwardly therefrom;

(b) providing a generally oblong ball;

(c) providing a goal in association with each of said end lines such that said goal defines a scoring area elevated above said playing field;

(d) providing a first team of players having as an objective to move said ball across said first goal line, without a player on said first team or said ball moving outside of said boundaries of play, wherein movement of said ball is accomplished by a player on said first team optionally
  (i) running with said ball,
  (ii) passing said ball to another player on said first team, or
  (iii) kicking said ball through said scoring area;

(e) providing a second team of players having as an objective to defend said first goal line by stopping the movement of said ball by said first team toward said first goal line, wherein said movement can be stopped by players of said second team by either optionally
  (i) tackling a player of said first team who is carrying said ball,
  (ii) disrupting a pass from one player of said first team to another, or
  (iii) disrupting an attempt by said first team to kick said ball through said scoring area;

(f) providing said first team with a predetermined number of successive plays to move said ball a predetermined distance wherein each play can be ended when a player on said first team or said ball travels outside said boundary of play, or optionally said second team either
  (i) tackles a player of said first team who is carrying said ball,
  (ii) disrupts a pass from one player of said first team to another, or
  (iii) disrupts an attempt by said first team to kick said ball through said scoring area;

(g) wherein said first team can kick the ball to score points, with the points allotted determined by the distance the ball is kicked;

(h) wherein said first team can elect to increase the distance said ball is kicked during an attempt to kick said ball through said scoring area; and, (i) wherein said first team can be penalized for missing an attempt to kick said ball through said scoring area.

2. The method of claim 1 wherein (a) a kick ranging between 0 and 10 yards equals 1 point;

(b) a kick ranging between 11 and 20 yards equals 2 points;

(c) a kick ranging between 21 and 25 yards equals 3 points;

(d) a kick ranging between 26 and 35 yards equals 4 points;

(e) a kick ranging between 36 and 45 yards equals 5 points;

(f) a kick ranging between 46 and 55 yards equals 6 points; and, (g) a kick ranging between 55 yards and beyond equals 7 points.

3. A method of playing football whereby specific point values are attributed to field goals kicked from predetermined distances, comprising the steps of:

(a) providing a generally rectangular playing field;

(b) providing a generally oblong ball;

(c) providing a goal in association with each of said end lines such that said goal defines a scoring area elevated above said playing field;

(d) allowing a team attempting to kick said ball through said scoring area to increase the distance from which said ball is kicked, wherein a kick that passes through the goal equates to a particular point value based on the distance from which the ball was kicked; and, (e) penalizing said team when an attempt to kick said ball through said scoring area fails.

4. A method for playing football, wherein said method comprises:

(a) selecting incremental distances an a football field to equate to different point values for made field goals where a football can pass through an area between uprights of a goalpost;

(b) allowing a team attempting to kick said football through said scoring area to elect to increase the distance from which said ball is kicked; and, (c) kicking the football, whereby a successful kick equals a certain point value based on the distance of the kick.

5. The method of claim 4 whereby the ball is marked down at the position from which the ball was kicked, if such kick was unsuccessful, with opposing team on defense taking over possession of the football.

6. The method or claim 4 wherein said method comprises limiting the number of times during a game that the election to move the football may be made.

7. The method of claim 4 wherein said method comprises assessing a penalty against a team kicking for a missed kick.

8. A method of playing football whereby specific point values are attributed to extra point field goals kicked from predetermined distances, comprising tile steps of:

(a) providing a generally rectangular playing field;

(b) providing a generally oblong football;

(c) providing a goal in association with each of said end lines such that said goal defines a scoring area elevated above said playing field (d) allowing a team attempting to kick said ball through said scoring area to increase the distance from which said ball is kicked, wherein a kick that passes through the goal equates to a particular point value based on the distance from which the ball was kicked; and, (e) penalizing said team when an attempt to kick said ball through said scoring area fails.

9. The method of claim 8 whereby the football is marked down at the position from which the ball was kicked, if such kick was unsuccessful, with opposing team on defense taking over possession of the ball.

10. The method of claim 8 wherein said method comprises limiting the number of times during a game that the election to move the football may be made.

* * * * *

UNITED STATES PATENT AND TRADEMARK OFFICE

CERTIFICATE OF CORRECTION

PATENT NO. : 6,503,159 B2
DATED : January 7, 2003
INVENTOR(S) : Harold T. Pehr

It is certified that error appears in the above-identified patent and that said Letters Patent is hereby corrected as shown below:

Title page, Item [54] and Column 1, line 1,
After the title "FOOTBALL GAME" add the words -- METHOD OF PLAY --

Signed and Sealed this

Twelfth Day of August, 2003

JAMES E. ROGAN
*Director of the United States Patent and Trademark Office*